US011058192B2

(12) United States Patent
Cluseau

(10) Patent No.: US 11,058,192 B2
(45) Date of Patent: Jul. 13, 2021

(54) JEWELLERY ARTICLE HAVING AT LEAST TWO PARTS MOVABLE IN ROTATION RELATIVE TO EACH OTHER

(71) Applicant: HERMES SELLIER, Paris (FR)

(72) Inventor: David Cluseau, Charenton le Pont (FR)

(73) Assignee: HERMES SELLIER, Paris (FR)

( * ) Notice: Subject to any disclaimer, the term of this patent is extended or adjusted under 35 U.S.C. 154(b) by 414 days.

(21) Appl. No.: 16/099,269

(22) PCT Filed: May 29, 2017

(86) PCT No.: PCT/FR2017/051336

§ 371 (c)(1),
(2) Date: Nov. 6, 2018

(87) PCT Pub. No.: WO2017/207908

PCT Pub. Date: Dec. 7, 2017

(65) Prior Publication Data

US 2020/0315305 A1 Oct. 8, 2020

(30) Foreign Application Priority Data

May 31, 2016 (FR) ..... 1654930

(51) Int. Cl.

| | |
|---|---|
| ***A44C 9/00*** | (2006.01) |
| *A44C 5/00* | (2006.01) |
| *A44C 13/00* | (2006.01) |

(52) U.S. Cl.

CPC ..... *A44C 9/003* (2013.01); *A44C 9/0023* (2013.01); *A44C 5/0092* (2013.01); *A44C 13/00* (2013.01); *A44D 2203/00* (2013.01)

(58) Field of Classification Search

CPC ..... A44C 9/003; A44C 9/0023; A44C 5/0092; A44C 13/00; A44C 17/02

(Continued)

(56) References Cited

U.S. PATENT DOCUMENTS 221,728 A * 11/1879 Halsey ..... A44C 9/0023 63/15.4
813,084 A * 2/1906 Dover ..... A44C 17/02 63/26

(Continued)

FOREIGN PATENT DOCUMENTS

EP 0 737 428 10/1996
EP 1 208 763 5/2002

(Continued)

OTHER PUBLICATIONS

International Search Report, PCT/FR2017/051336, dated Sep. 20, 2017.

*Primary Examiner* — Jack W Lavinder
(74) *Attorney, Agent, or Firm* — Nixon & Vanderhye

(57) ABSTRACT

Disclosed is a jewellery article including at least one first part having a first cylindrical inner face in which there is provided at least one groove, at least one second part having a second cylindrical inner face provided, in the extension of same, with at least one rim, the at least one rim being arranged facing the at least one groove, and at least one attachment member mechanically secured to the at least one rim of the at least one second part and extending into the at least one groove of the at least one first part; the at least one groove, the at least one rim and the at least one attachment member being configured to allow the at least one first part and the at least one second part to rotate freely with respect to each other.

20 Claims, 4 Drawing Sheets

(58) Field of Classification Search
USPC ..... 63/15
See application file for complete search history.

(56) References Cited

U.S. PATENT DOCUMENTS

| | | | | |
|---|---|---|---|---|
| 1,712,417 | A * | 5/1929 | Beaujard, Jr. ..... | A44C 9/003<br>63/15.3 |
| 5,161,392 | A | 11/1992 | Wiriath et al. | |
| 5,678,428 | A | 10/1997 | Pasquetti | |
| 2016/0037882 | A1 | 2/2016 | Heinz | |
| 2019/0174885 | A1 * | 6/2019 | Tata ..... | A44C 9/003 |

FOREIGN PATENT DOCUMENTS

| | | |
|---|---|---|
| FR | 2 659 000 | 9/1991 |
| WO | WO 2006/026887 | 3/2006 |
| WO | WO 2013/160755 | 10/2013 |

* cited by examiner

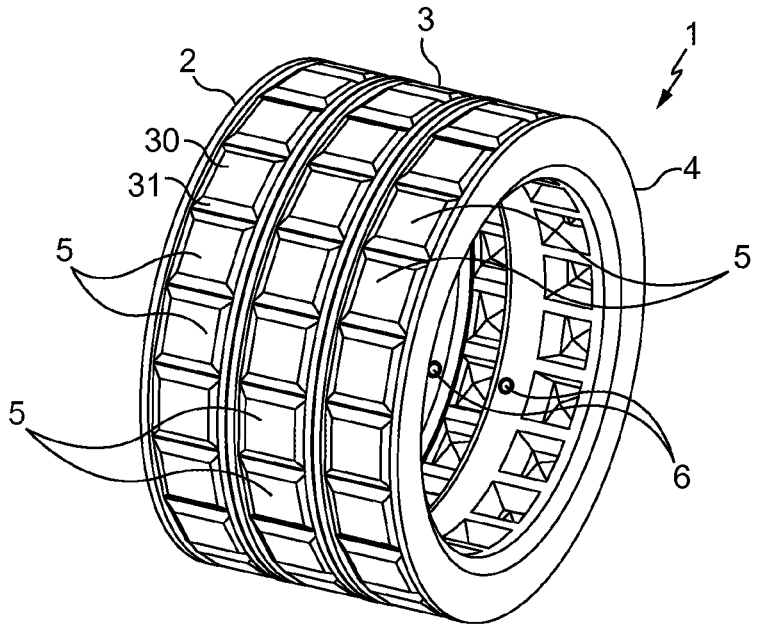
Fig. 1
Fig. 2
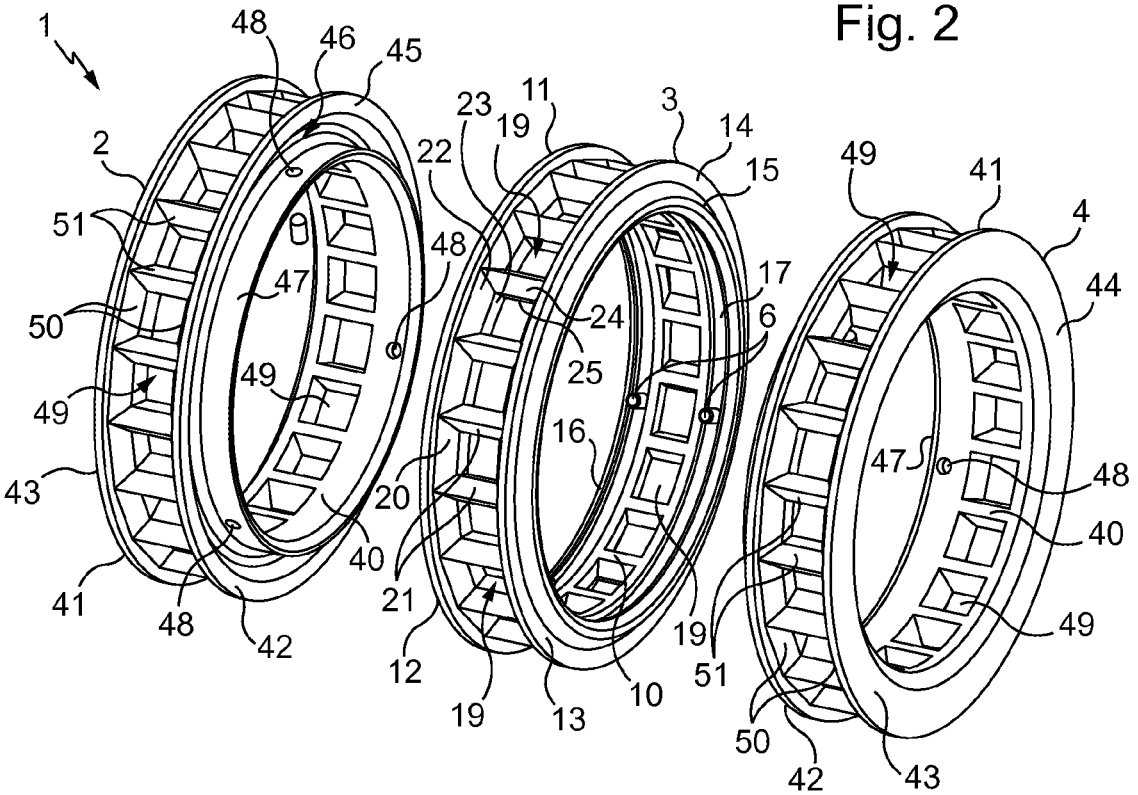

JEWELLERY ARTICLE HAVING AT LEAST TWO PARTS MOVABLE IN ROTATION RELATIVE TO EACH OTHER

FIELD OF THE INVENTION

The invention concerns the fields of lapidary work and jewelry and is directed to articles of lapidary work and/or jewelry, and in particular rings, provided with at least two parts that are rotatable relative to each other.

Such articles may be produced from precious or non-precious metals and may possibly comprise one or more ornamental members formed for example from precious or non-precious stones, or even from pieces of precious or non-precious metal.

TECHNOLOGICAL BACKGROUND

From European patent application 0 737 428 there is known a ring comprising an inside circlet formed by the assembly of two half-circlets each provided with an annular wall extending from a protuberant bearing surface, as well as an outside circlet concentric with the inside circlet, mounted on the inside circlet and trapped between the two protuberant surfaces, and having a greater diameter than the annular walls of the two half-circlets to be rotatable relative to the inside circlet.

From French patent application 2 659 000 there is also known a ring comprising coaxial outside and inside annuluses which are rotatably mounted relative to each other around a common axis. The inside annulus is provided with a central portion having an axial width slightly greater than the axial width of the outside annulus and which connects on opposite sides, to thinner ends via shoulders. The outside annulus is mounted on the central portion of the inside annulus and the ring further comprises two lateral parts each engaged on a respective thinner end, each coming to bear against a respective shoulder, and each being welded to the inside annulus; such that the lateral parts delimit together with the inside part a peripheral groove in which the outside annulus is held captive and is freely rotatable around the central portion of the inside annulus.

From European patent application 1 208 763 there is also known a ring provided with parts rotatable relative to each other. This ring comprises a friction system formed by two central parts having cylindrical portions and outside flanges placed against each other, an annulus passed over the flanges and provided with a notched rim positioned bearing against one of the flanges and with a free edge surface welded or bonded to the other of the flanges, as well as a blade spring welded at one end onto the cylindrical portion of one of the central parts, in contact with the rim of the annulus, and movable to cooperate with the notches of that rim. This ring further comprises two external parts having what are referred to as interior flanges and cylindrical portions which are disposed edge to edge around the assembly formed by the central parts, the annulus and the blade spring, and the interior flange of each external part is welded to the cylindrical portion of a respective central part. The angular rotation of the central parts relative to the other, associated with the fact that these central parts have variable thicknesses, enables the appearance of the ring to be modified.

SUBJECT OF THE INVENTION

The invention is directed to providing an article of lapidary work and/or of jewelry, in particular a ring, of a rather similar kind, which is particularly simple and convenient to manufacture.

The invention thus relates to an article of jewelry and/or of lapidary work, in particular a ring, comprising at least one first part and at least one second part, which are rotatable relative to each other, characterized in that said at least one first part has a first cylindrical inside face in which is provided at least one groove, said at least one second part has a second cylindrical inside face provided with at least one rim extending from it, said at least one rim is disposed opposite said at least one groove, and said article further comprises at least one fastening member mechanically connected to said at least one rim of said at least one second part and extending within said at least one groove of said at least one first part; said at least one groove, said at least one rim and said at least one fastening member being configured to enable the free rotation of said at least one first part and of said at least one second part relative to each other, through 360°.

The article of lapidary work and/or of jewelry according to the invention makes it possible, by virtue of the arrangement of said at least one groove, of said at least one rim and of said at least one fastening member, to provide a particularly simple and efficient system of assembly, which is freely rotatable, through 360°, of the parts which compose that article.

The arrangement of said at least one groove over the whole length of the inside face of the annulus, of said at least one rim and of said at least one fastening member also makes it possible to provide a particularly compact and discrete system.

It will be noted that, by mechanically connected, it is meant here that said at least one fastening member is securely fastened to said at least one rim and that it cannot detach therefrom by itself, that is to say without external action. Therefore, this fastening member cannot come out alone, that is to say without external action, from the groove in which it has been inserted.

According to preferred features of the article according to the invention which are particularly simple, convenient and economical:

- said at least one fastening member is formed by a pin configured to be inserted through an aperture provided in said at least one rim and to project into said at least one groove;
- said at least one groove defines a cavity in which said pin can move freely when at least one of said first and second parts is driven relative to the other;
- said at least one first part has first lateral walls on opposite sides of said first cylindrical inside face and said at least one groove is provided in immediate proximity to one of said first lateral walls;
- said at least one second part has second lateral walls on opposite sides of said second cylindrical inside face and said at least one rim extends projecting from one of said second lateral walls;
- said at least one first part is juxtaposed, by said lateral wall at the location of which is said groove, against said at least one second part by said lateral wall from which projects said at least one rim;
- said at least one first part is formed by a first annulus and said at least one second part is formed by a second annulus.
- said first annulus is solid and has a first outside face formed from a precious metal and/or said second annulus is solid and has a second outside face also formed from a precious metal which is identical or different;

said first annulus has a first outside face in which is provided at least one first recess and said article further comprises at least one first ornamental member securely mounted in said at least one recess and/or said second annulus has a second outside face in which is provided at least one second recess and said article further comprises at least one second ornamental member securely mounted in said at least one second recess;

said at least one first recess opens into said first cylindrical inside face and/or said at least one second recess opens into said second cylindrical inside face;

said at least one first recess and/or said at least one second recess have a contour delimited by two lateral faces that face each other and two transverse faces that face each other and which are each connected to the two said lateral faces;

each of said lateral and transverse faces has a first straight portion and a second portion which is inclined relative to the first straight portion and connected thereto; thereby forming a first recess and/or a second recess, substantially in the shape of a funnel;

said first straight portion of each of said lateral and transverse faces issues at the location of said first cylindrical inside face or said second cylindrical inside face;

said second inclined portion of each of said lateral and transverse faces issues at the location of said first outside face or of said second outside face; and/or said article forms a ring provided with a said first part in the form of an annulus having two said grooves provided in its first cylindrical inside face, with two said second parts in the form of annuluses, which are arranged on opposite sides of said first part and which each have a said rim disposed opposite one of the two said grooves, with a plurality of said fastening members mechanically connected to said rims and which extend in said grooves opposite said respective rims; whereby each of said annuluses is free to rotate relative to the other annuluses.

BRIEF DESCRIPTION OF THE DRAWINGS

The disclosure of the invention will now be continued with the description of embodiments, given below by way of illustrative and non-limiting examples, with reference to the accompanying drawings, in which:

FIG. 1 is a perspective view of what is referred to as an article of lapidary work, according to the invention;

FIG. 2 is an exploded perspective view of the article illustrated in FIG. 1;

DETAILED DESCRIPTION OF EMBODIMENTS

Figure 3:
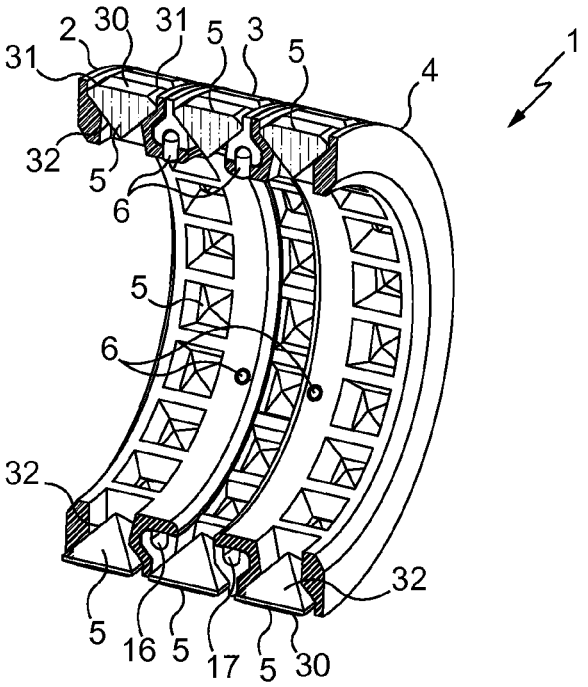
FIGS. 3 and 4 are perspective views similar to those of FIGS. 1 and 2, showing the article in medial cross-section.

FIG. 1 shows an article of lapidary work, formed by a ring 1 here comprising a first central annulus 3, also referred to as first part, and two second lateral annuluses 2 and 4, also referred to as second parts, which are each formed from a precious metal and ornamented with a plurality of precious stones 5.

The second lateral annuluses 2 and 4 are fully identical here and will be described, below in the present disclosure, using the same numerical references.

The first central annulus 3 and the two lateral annuluses 2 and 4 are assembled together by means of pins 6, also called fastening members, such that each of them is rotatable relative to the others, through 360°. These pins 6 are here in the form of cylindrical rods and have a predetermined diameter and a length that is also predetermined.

In other words, the first central annulus 3 may be freely rotated through 360° relative to the two second lateral annuluses 2 and 4, the second lateral annulus 2 may be freely rotated through 360° relative to the first central annulus 3 and relative to the other second lateral annulus 4, and the latter may also be freely rotated through 360° relative to the first central annulus 3 and the second lateral annulus 2. It will be noted that the annuluses 2, 3 and 4 are movable in both directions of rotation and that they may at the same time rotate relative to the others, in the same direction or in opposite directions.

A description will be given in more detail of each of these annuluses 2, 3 and 4 and also of the precious stones 5 with reference to FIGS. 2 to 4.

The first central annulus 3 has a first cylindrical inside face 10 and a first outside face 11 which is an opposite face to the first cylindrical inside face 10.

The first central annulus 3 furthermore has two first lateral walls 12 and 13 disposed on respective opposite sides of the first cylindrical inside face 10 and of the first outside face 11, each of these first lateral walls 12 and 13 connecting at the same time the first cylindrical inside face 10 and the first outside face 11.

Each of the first lateral walls 12 and 13 is formed by a straight portion 14 and by a protuberance 15 extending from that straight portion 14.

The first central annulus 3 is provided with a first groove 16 and with a second groove 17 which are each provided in and along the whole length of the first cylindrical inside face 10, in immediate proximity to a first respective lateral wall 12, 13 and at the location of their respective protuberance 15.

Figure 4:
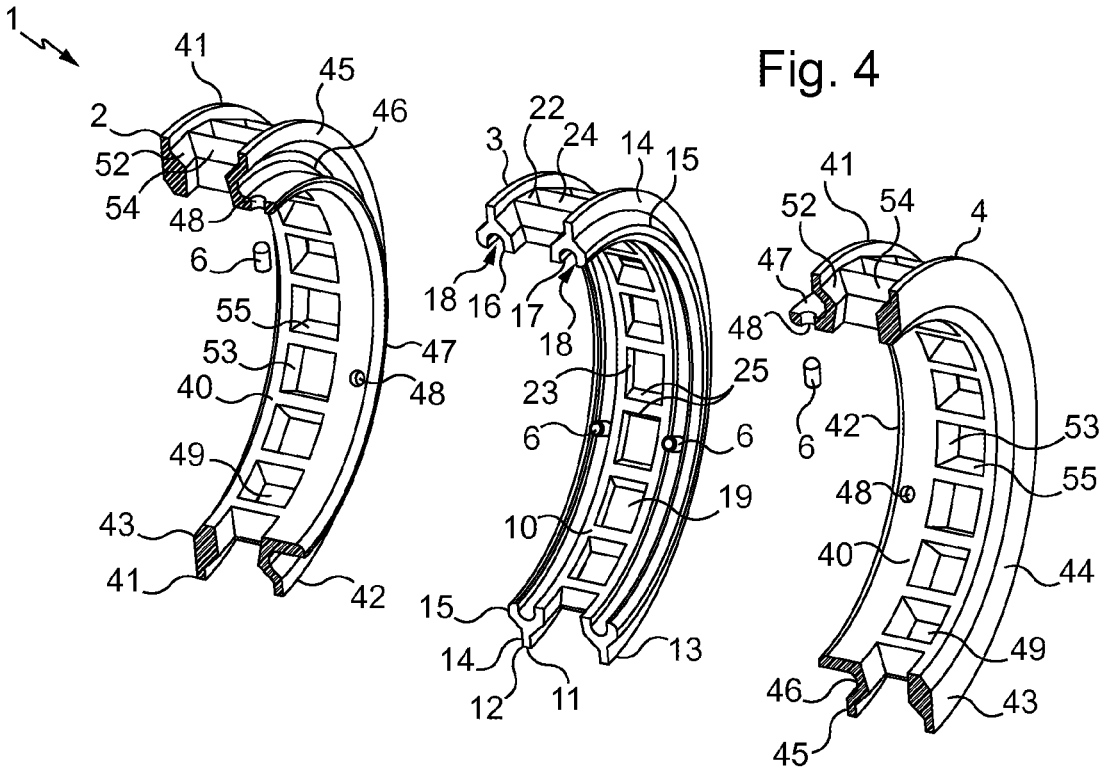
Figure 5:
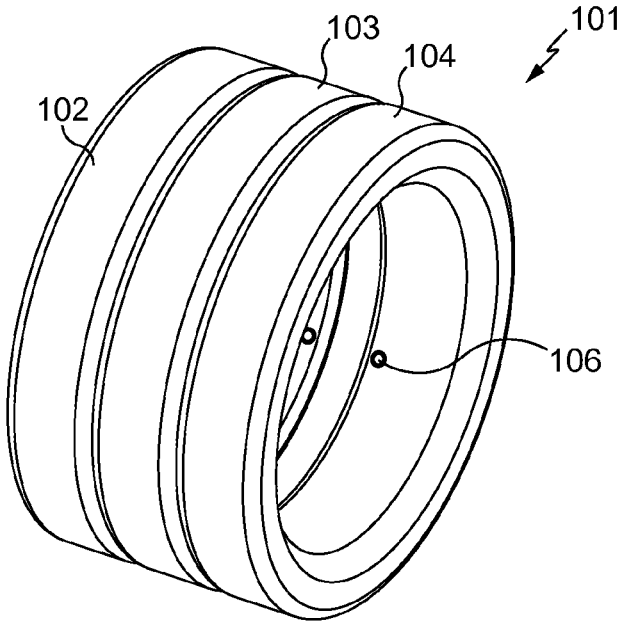
FIGS. 5 to 8 are similar views to that of FIGS. 1 to 4, of what is referred to as an article of jewelry, also in accordance with the invention.
Figure 6:
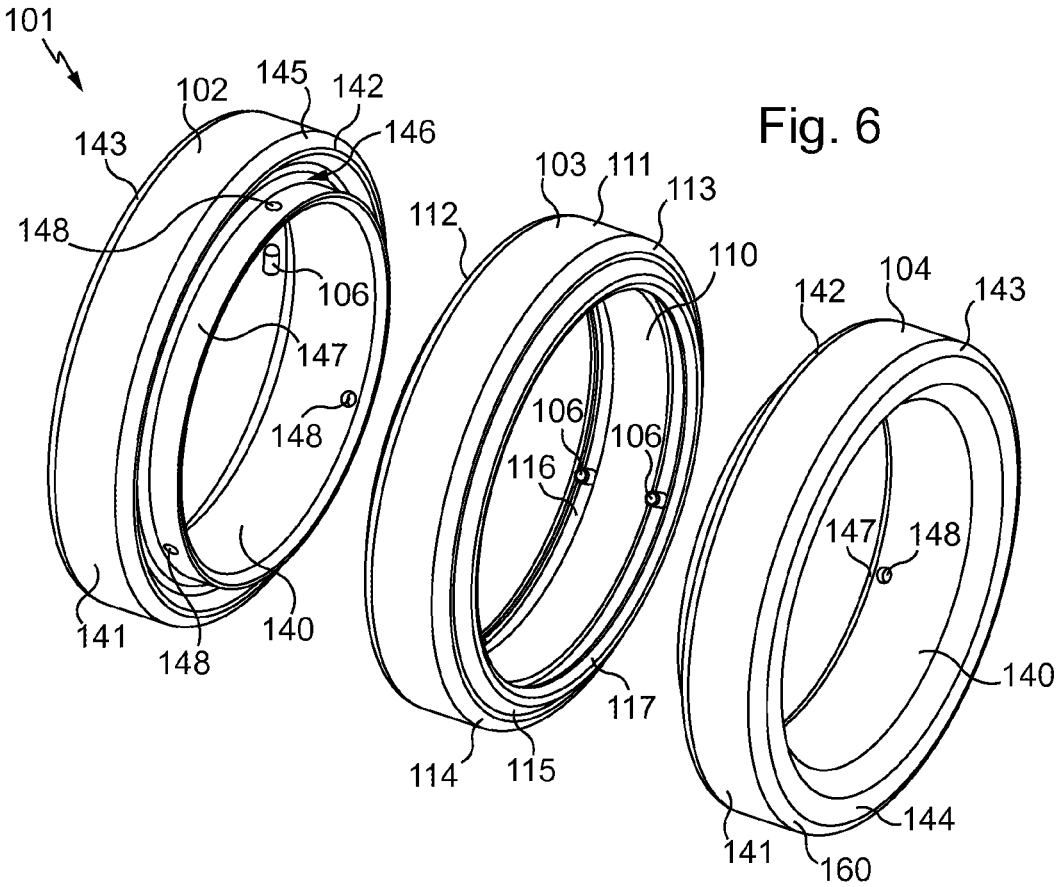
Figure 7:
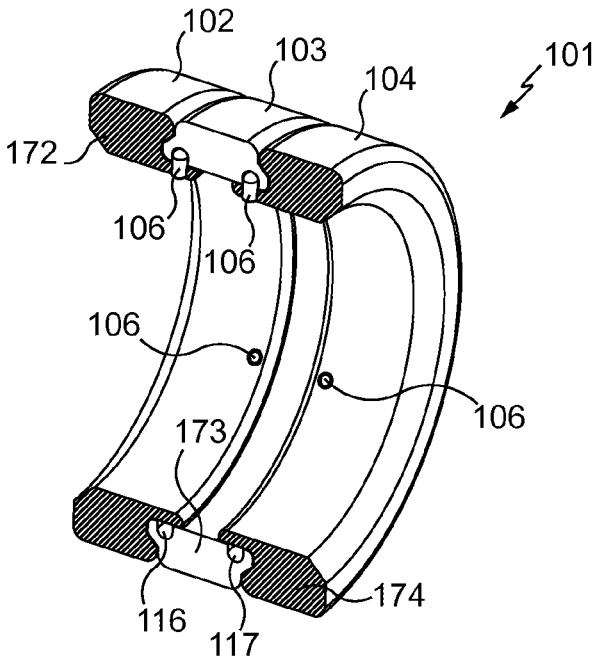

These first and second grooves 16 and 17 each define a cavity 18, here substantially gutter-shaped (FIG. 4).

The first central annulus 3 is furthermore provided with a plurality of first recesses 19 formed in its first outside face 11 and opening into the first cylindrical inside face 10.

Each first recess 19 has a contour delimited by two lateral faces 20 which face each other and two transverse faces 21 which face each other, the latter each being connected to the two lateral faces 20.

The lateral faces 20 each have a first straight portion 23 and a second portion 22 which is inclined relative to the first straight portion 23 and which is connected to that first straight portion 23.

The transverse faces 21 each also have a first straight portion 25 and a second portion 24 which is inclined relative to the first straight portion 25 and which is connected to that first straight portion 25.

The first straight portions 23 and 25 issue at the location of the first cylindrical inside face 10 and the second inclined portions 22 and 24 issue at the location of the first outside face 11.

Each first recess 19 thereby forms a substantially funnel-shaped accommodation configured to receive a precious stone 5.

Each precious stone 5 thus has a shape enabling its insertion into such an accommodation.

Here, each precious stone 5 has in particular a substantially flat facet 30, four beveled edges 31 extending from the facet 30 and a pyramidal lower base 32 extending from each believed edge 31 and which is inserted into a respective first recess 19, the vertex of the pyramid being directed into the first cylindrical inside face 10.

Each precious stone 5 is securely mounted, for example by crimping, in a first respective recess 19 such that its facet 30 is disposed here substantially flush with the first outside face 11 of the first central annulus 3.

The two second lateral annuluses 2 and 4 each have a second cylindrical inside face 40 and a second outside face 41 which is an opposite face to the first cylindrical inside face 40.

The two second lateral annuluses 2 and 4 furthermore each have two second lateral walls 42 and 43 disposed on respective opposite sides of the second cylindrical inside face 40 and the second outside face 41, each of these two lateral walls 42 and 43 connecting at the same time the second cylindrical inside face 40 and the second outside face 41.

The second lateral walls 43 are here formed from a straight portion 45 and from a groove 46 extending from that straight portion 45; while the second lateral walls 42 are formed here from a single straight portion 44.

The two second lateral annuluses 2 and 4 are each provided with an annular rim 47 provided extending from the second cylindrical inside face 40 and which projects from a respective second lateral wall 42, and in particular from a respective groove 46.

The rim 47 of each of the two second lateral annuluses 2 and 4 is provided with a plurality of apertures 48 of predetermined diameter provided for receiving the pins 6 and is configured to form a bearing surface for the first cylindrical inside face 10 of the first central annulus 3.

The two second lateral annuluses 2 and 4 are furthermore each provided with a plurality of second recesses 49 provided in its second outside face 41 and opening into the second cylindrical inside face 40.

These second recesses 49 are similar to the first recesses 19 of the first central annulus 3.

Each second recess 49 has a contour delimited by two lateral faces 50 which face each other and two transverse faces 51 which face each other, the latter each being connected to the two lateral faces 50.

The lateral faces 50 each have a first straight portion 53 and a second portion 52 which is inclined relative to the first straight portion 53 and which is connected to that first straight portion 53.

The transverse faces 51 each also have a first straight portion 55 and a second portion 54 which is inclined relative to the first straight portion 55 and which is connected to that first straight portion 55.

The first straight portions 53 and 55 issue at the location of the second cylindrical inside face 40 and the second inclined portions 52 and 54 issue at the location of the first outside face 41.

Each second recess 49 thus forms a substantially funnel-shaped accommodation configured to receive a precious stone 5, as described above, that is to say having a shape enabling its insertion into such an accommodation, and in particular a substantially flat facet 30, four beveled edges 31 extending from the facet 30 and a pyramidal lower base 32 extending from each believed edge 31 and which is inserted into a respective first recess 19, the vertex of the pyramid being directed towards the first cylindrical inside face 10. Each precious stone 5 is securely mounted, for example by crimping, in a second respective recess 49 such that its facet 30 is disposed here substantially flush with the first outside face 11 of the first central annulus 3.

A description will now be given if the assembling of the ring 1 still with reference to FIGS. 2 to 4.

The first central annulus 3 is sandwiched between the two second lateral annuluses 2 and 4.

The first central annulus 3 is juxtaposed, by its first lateral wall 12 and in particular here its straight portion 14, against the second lateral annulus 2, by its second lateral wall 42 and in particular here its straight portion 45; such that the first cylindrical inside face 10 rests partially on the rim 47 of the second lateral annulus 2, with the protuberance 15 of that first lateral wall 12 partially received in the groove 46 of that second lateral wall 42; and with the rim 47 thus disposed opposite the first groove 16.

The first central annulus 3 is also juxtaposed, by its first lateral wall 13 and in particular here its straight portion 14, against the second lateral annulus 4, by its second lateral wall 42 and in particular here its straight portion 45; such that the first cylindrical inside face 10 rests partially on the rim 47 of the second lateral annulus 4, with the protuberance 15 of that first lateral wall 12 partially received in the groove 46 of that second lateral wall 42; and with the rim 47 thus disposed opposite the second groove 17.

It will be noted that the annular rims 47 here have an outside diameter and the first cylindrical inside face 10 has an inside diameter greater than the outside diameter of the annular rims 47 to enable the relative rotational mobility of the annuluses 2, 3 and 4 relative to each other, through 360°.

The apertures 48 provided in the rims 47 of the two second lateral annuluses 2 and 4 are arranged so as to open into the cavities 18 defined by the first and second grooves 16 and 17.

The pins 6 are inserted through apertures 48 to project into the respective cavities 18 of the first and second grooves 16 and 17 and are mechanically connected to the respective rims 47, for example on account of their insertion by force or by welding or by crimping.

The pins 6 are inserted into the apertures 48 so as to arrive flush with the second inside face 40 of the respective second lateral annulus 2, 4.

It will be noted that the diameter of the apertures 48 and the diameter of the pins 6 are predetermined to enable such mechanical connection.

It will furthermore be noted that the respective cavities 18 of the first and second grooves 16 and 17 have depths which enable the pins 6 to be received such that they become trapped in the cavities 18 and furthermore such that they translate freely in the cavities 18 when the annuluses 2, 3 and/or 4 are rotationally driven relative to each other.

Thus, the cooperation of the first and second grooves 16 and 17, of the rims 47 and of the pins 6 enables the free rotation of each of the annuluses 2, 3 and 4 relative to each other.

FIGS. 5 to 8 represent an article of jewelry 101 according to a variant embodiment of the article 1 illustrated in FIGS. 1 to 4.

Generally, the same reference numbers have been used for similar parts, but with the number 100 added.

The ring 101 is differentiated from the ring 1 in that the annuluses 102, 103 and 104 are here formed by solid bodies respectively 172, 173 and 174 (FIG. 8), which are produced from precious metals which are identical or different from each other. These annuluses 102, 103 and 104 thus lack ornamental members such as precious stones. The second lateral annuluses 102 and 104 are fully identical here and will be described, below in the present disclosure, using the same numerical references.

The first central annulus 103 and the two lateral annuluses 102 and 104 are assembled together by means of pins 106 such that each of them is rotatable relative to the others. These pins 106 are here in the form of cylindrical rods of predetermined diameter and length.

The first central annulus 103 has a first cylindrical inside face 110 and a first outside face 111 which is an opposite face to the first cylindrical inside face 110; two first lateral walls 112 and 113 disposed on respective opposite sides of the first cylindrical inside face 110 and of the first outside face 111, each of these first lateral walls 112 and 113 connecting at the same time the first cylindrical inside face 110 and the first outside face 111. Each of the first lateral walls 112 and 113 is formed by a chamfer portion 114 which is continued by a protuberance 115.

The first central annulus 103 is provided with a first groove 116 and with a second groove 117 which are each provided in the first cylindrical inside face 110, in immediate proximity to a first respective lateral wall 112, 113 and at the location of their respective protuberance 115.

Figure 8:
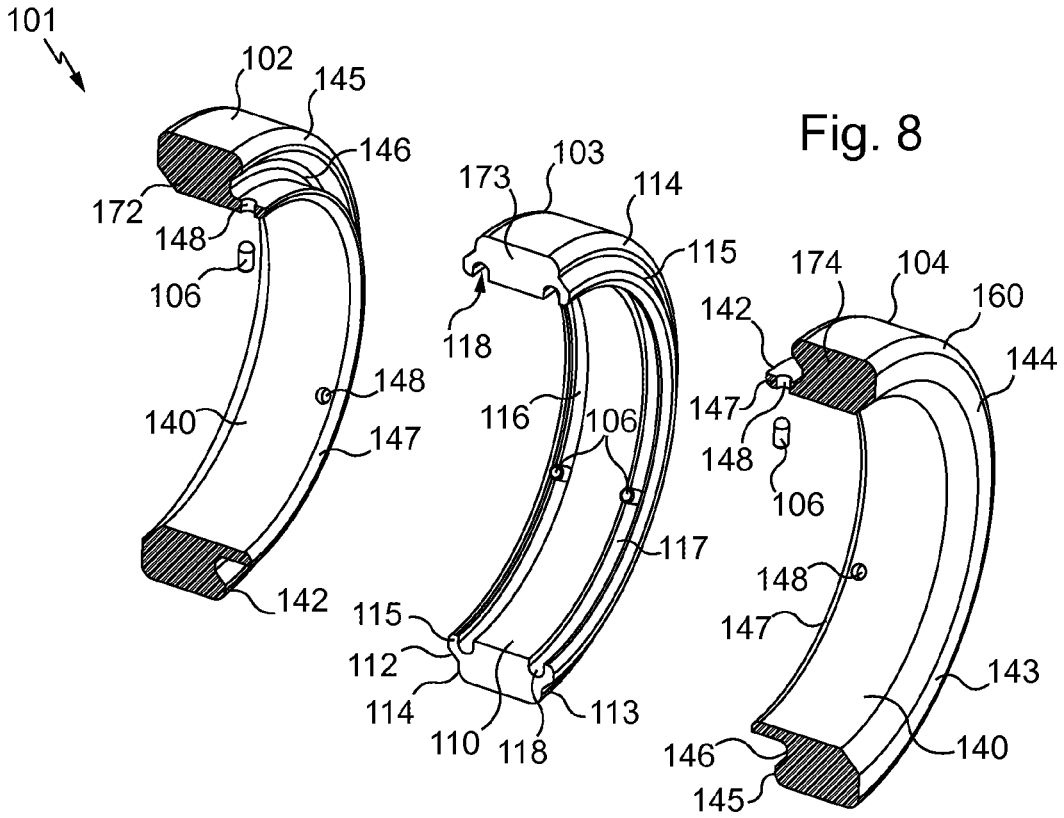

These first and second grooves 116 and 117 each define a cavity 118, here substantially gutter-shaped and of predetermined depth (FIG. 8).

The two second lateral annuluses 102 and 104 each have a second cylindrical inside face 140 and a second outside face 141 which is an opposite face to the first cylindrical inside face 140; two second lateral walls 142 and 143 disposed on respective opposite sides of the second cylindrical inside face 140 and of the second outside face 141, each of these second lateral walls 142 and 143 connecting at the same time the second cylindrical inside face 140 and the second outside face 141.

The second lateral walls 143 are here formed by a chamfer portion 145 which is extended by a groove 146; while the second lateral walls 142 are here formed by a straight portion 144 which is extended by a chamfer portion 160 connected to the second outside face 141.

The two second lateral annuluses 102 and 104 are each provided with an annular rim 147 provided extending from the second cylindrical inside face 140 and which projects from a respective second lateral wall 142, and in particular from a respective groove 146.

The rim 147 of each of the two second lateral annuluses 102 and 104 is provided with a plurality of apertures 148 of predetermined diameter provided for receiving the pins 106 and is configured to form a bearing surface for the first cylindrical inside face 110 of the first central annulus 103.

The first central annulus 103 is sandwiched between the two second lateral annuluses 102 and 104.

The first central annulus 103 is juxtaposed, by its first lateral wall 112 against the second lateral annulus 102, by its second lateral wall 142; such that the first cylindrical inside face 110 rests partially on the rim 147 of the second lateral annulus 102, with the protuberance 115 of that first lateral wall 112 partially received in the groove 146 of that second lateral wall 142; and with the rim 147 thus disposed opposite the first groove 116.

The first central annulus 103 is also juxtaposed, by its first lateral wall 113, against the second lateral annulus 104, by its second lateral wall 142; such that the first cylindrical inside face 110 rests partially on the rim 147 of the second lateral annulus 104, with the protuberance 115 of that first lateral wall 112 partially received in the groove 146 of that second lateral wall 142; and with the rim 147 thus disposed opposite the second groove 117.

It will be noted that the annular rims 147 here have an outside diameter and the first cylindrical inside face 110 has an inside diameter greater than the outside diameter of the annular rims 147 to enable the relative rotational mobility of the annuluses 102, 103 and 104 relative to each other.

The apertures 148 provided in the rims 147 of the two second lateral annuluses 102 and 104 are arranged so as to open into the cavities 118 defined by the first and second grooves 116 and 117.

The pins 106 are inserted through apertures 148 to project into the respective cavities 118 of the first and second grooves 116 and 117 and are mechanically connected to the respective rims 147, for example on account of their insertion by force or by welding or by crimping.

The pins 106 are inserted into the apertures 148 so as to arrive flush with the second inside face 140 of the respective second lateral annulus 102, 104.

It will be noted that the diameter of the apertures 148 and the diameter of the pins 16 are predetermined to enable such mechanical connection.

It will furthermore be noted that the respective cavities 118 of the first and second grooves 116 and 117 have depths which enable the pins 106 to be received such that they become trapped in the cavities 118 and furthermore such that they translate freely in the cavities 118 when the annuluses 102, 103 and/or 104 are rotationally driven relative to each other.

Thus, the cooperation of the first and second grooves 116 and 117, of the rims 147 and of the pins 106 enables the free rotation of each of the annuluses 102, 103 and 104 relative to each other.

In variants that are not illustrated:

- the ring may comprise a first annulus provided with a single groove and only one second lateral annulus;
- the ring may comprise several first annuluses each interposed between two second annuluses;
- the first and second outside faces may be ornamented with members other than precious stones, for example non-precious stones or accessories such as pendants; and/or
- the pins may be different from cylindrical rods, they may for example be in the form of anchors or hooks.

It should be noted more generally that the invention is not limited to the examples described and represented.

The invention claimed is:

1. An article of jewelry and/or of lapidary work that is a ring, the article comprising:

at least one first part and at least one second part which are rotatable relative to each other, said at least one first part having a first cylindrical inside face in which at least one groove is provided, said at least one second part having a second cylindrical inside face provided with at least one rim extending from the second cylindrical inside face, said at least one rim being disposed opposite said at least one groove; and at least one fastening member mechanically connected to said at least one rim of said at least one second part and extending within said at least one groove of said at least one first part, said at least one groove, said at least one rim, and said at least one fastening member being configured to enable the free rotation of said at least one first part and said at least one second part relative to each other, each of said at least one fastening member being a pin configured to be inserted through an aperture provided in said at least one rim and to project into said at least one groove, the pin extending radially inward with respect to an outer circumferential surface of the at least one first part and engages the aperture in the at least one rim of the at least one second part.

2. The article according to claim 1, wherein said at least one groove defines a cavity in which said pin is configured to move freely when at least one of said first and second parts is driven relative to the other.

3. The article according to claim 2, wherein said at least one first part has lateral walls on opposite sides of said first cylindrical inside face, and said at least one groove is provided in immediate proximity to one of said lateral walls.

4. The article according to claim 2, wherein said at least one second part has lateral walls on opposite sides of said second cylindrical inside face, and said at least one rim extends projecting from one of said lateral walls.

5. The article according to claim 1, wherein said at least one first part has lateral walls on opposite sides of said first cylindrical inside face, and said at least one groove is provided in immediate proximity to one of said lateral walls.

6. The article according to claim 5, wherein said at least one second part has lateral walls on opposite sides of said second cylindrical inside face, and said at least one rim extends projecting from one of said lateral walls.

7. The article according to claim 6, wherein said at least one first part is juxtaposed, by said lateral wall at the location of which is said groove, against said at least one second part by said lateral wall from which said at least one rim projects.

8. The article according to claim 1, wherein said at least one first part is formed by a first annulus, and said at least one second part is formed by a second annulus.

9. The article according to claim 8, wherein said first annulus is solid and has a first outside face formed from a precious metal, and/or said second annulus is solid and has a second outside face formed from a precious metal which is identical or different.

10. The article according to claim 8, wherein said first annulus has a first outside face in which at least one first recess is provided, said article further comprising at least one first ornamental member securely mounted in one or more of said at least one recess and said second annulus having a second outside face in which at least one second recess is provided; and at least one second ornamental member securely mounted in said at least one second recess.

11. The article according to claim 10, wherein one or more of said at least one first recess opens into said first cylindrical inside face, and said at least one second recess opens into said second cylindrical inside face.

12. The article according to claim 10, wherein one or more of said at least one first recess and said at least one second recess have a contour delimited by two lateral faces that face each other and two transverse faces that face each other and which are each connected to the two lateral faces.

13. The article according to claim 12, wherein each of said lateral and transverse faces has a first straight portion and a second portion which is inclined relative to said first straight portion and connected thereto, thereby forming one or more of a first recess and a second recess, substantially in the shape of a funnel.

14. The article according to claim 13, wherein said first straight portion of each of said lateral and transverse faces issues at the location of said first cylindrical inside face or said second cylindrical inside face.

15. The article according to claim 13, wherein said second inclined portion of each of said lateral and transverse faces issues at the location of said first outside face or of said second outside face.

16. The article according to claim 1, wherein said article is a ring provided with the at least one said first part in the form of an annulus having two of the at least one groove provided in the first cylindrical inside face, two of the at least one second part in the form of annuluses, which are arranged on opposite sides of said first part and which each have a rim of the at least one rim disposed opposite one of the two grooves, and a plurality of fastening members of the at least one fastening member mechanically connected to said rims and which extend in said grooves opposite said respective rims, wherein each of said annuluses is free to rotate relative to the other annuluses.

17. The article according to claim 1, wherein said at least one second part has lateral walls on opposite sides of said second cylindrical inside face, and said at least one rim extends projecting from one of said lateral walls.

18. The article according to claim 1, wherein the at least one groove comprises at least one cavity, and the pin is configured to project into the at least one cavity of the at least one groove and is configured to be mechanically connected to the at least one rim by one of insertion by force, welding, and crimping.

19. The article according to claim 18, wherein the at least one cavity is configured having a depth to receive the pin such that the pin is trapped in the at least one cavity, the pin being configured to translate freely in the at least one cavity when the at least one first part and the at least one second part are rotationally drive relative to each other.

20. The article according to claim 1, wherein the pin is configured to be inserted into the aperture to be flush with the second cylindrical inside face of the at least one second part.

* * * * *